United States Patent [19]

Gerbert-Gaillard et al.

[11] 4,276,527

[45] Jun. 30, 1981

[54] MULTIPOLE ELECTRICAL CIRCUIT BREAKER WITH IMPROVED INTERCHANGEABLE TRIP UNITS

[75] Inventors: Alain Gerbert-Gaillard, Tullins; Robert Morel, Eybens, both of France

[73] Assignee: Merlin Gerin, Grenoble, France

[21] Appl. No.: 47,227

[22] Filed: Jun. 11, 1979

[30] Foreign Application Priority Data

Jun. 23, 1978 [FR] France ..... 78 19422

[51] Int. Cl.[3] ..... H01H 73/48

[52] U.S. Cl. ..... 335/39; 335/23; 335/40

[58] Field of Search ..... 335/39, 38, 40, 42, 335/176, 204, 236, 237, 22, 23, 35, 170, 172, 174, 8, 9, 10, 41

[56] References Cited

U.S. PATENT DOCUMENTS 2,939,929 6/1960 Hobson, Jr. ..... 335/35

3,296,564 1/1967 Cellerini ..... 335/40

3,693,122 9/1972 Willard ..... 335/236

FOREIGN PATENT DOCUMENTS 322095 11/1929 United Kingdom .

855018 11/1960 United Kingdom ..... 335/236

1482630 8/1977 United Kingdom .

*Primary Examiner*—Harold Broome

*Attorney, Agent, or Firm*—Stevens, Davis, Miller & Mosher

[57] ABSTRACT

A molded case multi-pole circuit breaker comprises an interchangeable trip unit having a magnetic circuit surrounding a main stationary conductor and provided with a U-shaped core secured to circuit-breaker assembly and a magnetic rod fastener to the trip unit. The rod is inserted between the legs of the core, and a single turn secondary winding surrounds the rod. A bimetal is attached to the winding, and the thermal tripping characteristics are independent of the relative position of the magnetic core and rod.

6 Claims, 4 Drawing Figures

MULTIPOLE ELECTRICAL CIRCUIT BREAKER WITH IMPROVED INTERCHANGEABLE TRIP UNITS

The invention relates to a molded case multi-pole circuit breaker comprising:

(a) a current breaking assembly including adjacent poles having each a pair of separable contacts;

(b) a removable trip unit provided with thermal and electromagnetic trip means associated to the different poles for causing said contacts to move to an open position when the electric current attains a predetermined value;

(c) each pole of said trip means comprising an annular magnetic circuit formed by two separable portions, namely a first portion having a U-shaped core member with opposite legs and a second portion including a separate rod member;

(d) a main conductor extending through said magnetic circuit, one of said portions being supported by the breaking assembly and the other being secured to the trip unit.

It has been known to dispose a range of trip units of different tripping characteristics which may be selectively associated to a same breaking assembly to provide circuit breakers of different ratings. The use of the same breaking assembly is particularly interesting for high current ratings, for instance above 200 amps, in which the current detection occurs by means of an annular magnetic circuit surrounding the main input or output conductor of the circuit breaker. The arrangement of the main conductor within a closed magnetic circuit constitutes a locking device, and the removal of a trip unit needs the releasing of said device which requires either the disconnecting of the main conductor or the opening of the magnetic circuit. In prior art trip units having disconnecting main conductors, it is necessary to restore the electrical connection by means of screws or bolts, and it is clear that a defective screwing causes a dangerous overheating of the apparatus. The present invention belongs to the second type in which the electrical continuity of the main conductor is maintained, while the magnetic circuit comprises two separable portions, one of said portion being secured to the breaking assembly and the other portion being attached to the trip unit. The magnetic air gaps arranged between the two separable portions of the magnetic circuit determine the tripping characteristics of the thermal trip means provided generally with a short-circuit loop surrounding the magnetic circuit, and a bimetal attached to the loop which acts as a heating member. The thermal tripping characteristics of the trip unit are affected by small variations of said air gaps, and a known prior device uses non-magnetic shims inserted between the two separable portions of the magnetic circuit. Elastic mens biases the two portions into engagement with each other, but the precision and the correct positioning of the two magnetic portions is not perfect.

The object of the present invention is to provide a circuit breaker associated to an improved interchangeable trip unit having clearly defined tripping characteristics.

The circuit breaker according to the invention comprises a second magnetic portion which upon assembling of said trip unit is inserted between opposite legs of said first portion including a U-shaped core member. Magnetic air gap means are arranged between said legs and the end faces of said second portion so as the sum of said air gap means is independent of the relative position of said second portion with respect to said first portion.

Upon insertion of the magnetic rod between the legs of U-shaped core, we note that the value of the magnetic air gap is independent of the rod depth and of any lateral displacement causing a decrease of one air gap and a corresponding increase of the opposite air gap, because only the sum of these air gaps may affect the tripping characteristics.

Other advantages will become apparent from the following description of preferred embodiments of the invention, given by way of illustration and not of limitation, and shown in the accompanying drawings, in which.

Figure 1:
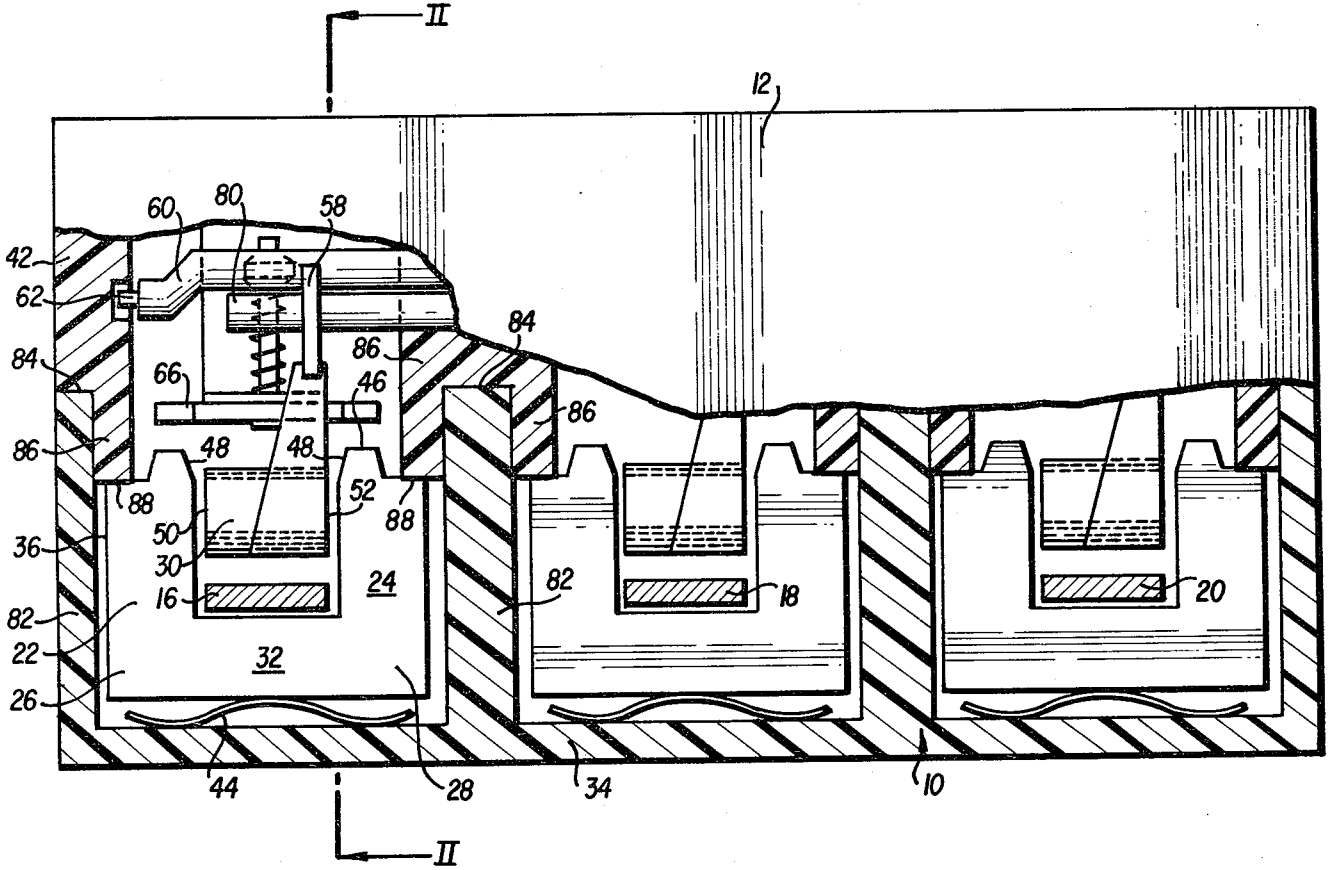
FIG. 1 shows a schematic view with parts broken away, of a trip unit secured to a multi-pole circuit breaker assembly in accordance with the invention.

Referring to the drawings, there is shown a molded case circuit-breaker assembly 10 which comprises three adjacent individual poles having each a terminal 14 provided at the end of a conductor 16, 18, 20 connected to the contacts 17, 19 of the circuit-breaker. A removable trip unit 12 secured to one face of circuit breaker is provided with a molded insulating housing including current sensing circuit elements and trip actuating means cooperating with the operating mechanism 21 of circuit breaker 10 on the occurrence of predetermined fault current conditions.

Any one interchangeable trip unit, enclosed in a wide range of trip units having different tripping characteristics, may be positioned on a same circuit-breaker assembly. Thermal and electromagnetic trip means are associated to each pole for causing the circuit breaker to be tripped respectively upon the occurrence of overload or short-circuit current conditions. Such well-known circuit-breakers having interchangeable trip unit will not be further described in detail.

The trip means associated to each pole of circuit breaker 10 are identical, and only one of them will be described, more particularly the one associated to conductor 16.

The conductor 16 is inserted between opposite legs of a U-shaped core 26 of a magnetic circuit 28 which surrounds the conductor 16. The second part or portion of magnetic circuit 28 comprises a rod 30 inserted in the active position between the free ends of the spaced legs 22, 24. The conductor 16 lies on the bottom 34 of the circuit-breaker 10 base which includes a cavity 36 in which the base portion 32 of the U-shaped core 26 is held between the conductor 16 and the bottom of the cavity 36. The legs 22, 24 of core 26 project upwardly and the rod 30 of magnetic circuit 28 is secured to the trip unit 12 by means of a distorted U-shaped bracket 38 fixed by screws 40 to the molded housing 42 of trip unit 12. The U-shaped core 26 is housed with a predetermined clearance into cavity 36 and a leafspring 44, inserted between the bottom of cavity 36 and the portion 32, urges the U-shaped core 26 upwardly so that portion 32 comes into engagement with conductor 16.

The front faces 46 of legs 22, 24 are provided with inner bevelled edges 48 which cause the self-centering of rod 30 upon its insertion between the legs 22, 24 during the assembling of trip unit 12 with circuit-breaker assembly 10. The length of rod 30 is smaller than space between legs 22, 24 so as to define opposite magnetic air gaps 50, 52 on both sides. The air gap surface of rod 30 is smaller than the one of legs 22, 24. A longitudinal displacement of rod 30 towards the left on FIG. 1 causes a decrease of air gap 50 and a corresponding increase of opposite air gap 52. The sum of air gaps 50, 52 remains constant so that the total reluctance of magnetic circuit 28 is not affected.

Figure 2:
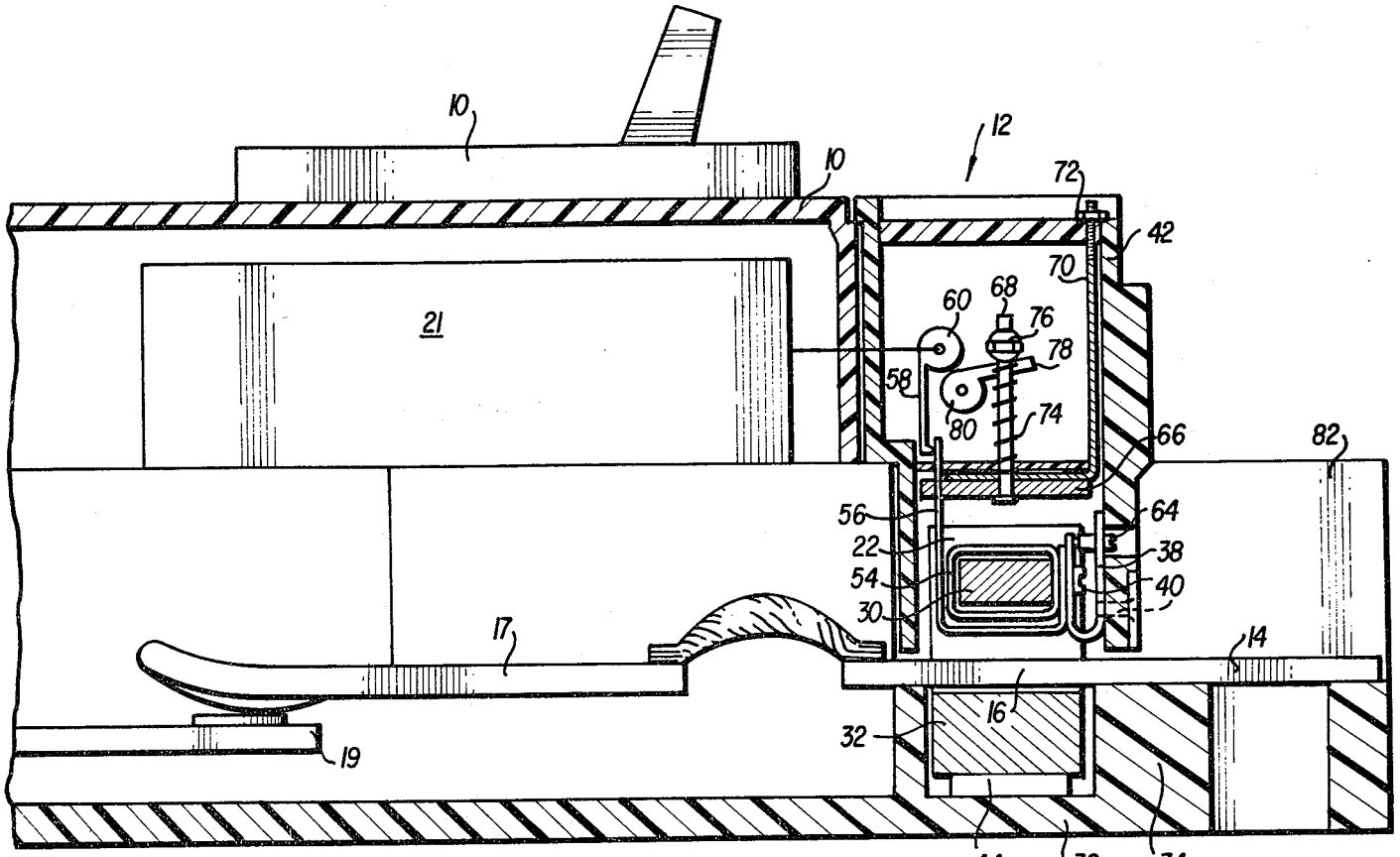
FIG. 2 is a vertical cross section taken through line II—II of FIG. 1.

A single-turn secondary winding 54 or heating member surrounds rod 30 and a bimetal 56 is attached to the loop by one end inserted between bracket 38 and one face of winding 54. Upon the occurrence of an overload current the heat generated in the heating member is conducted to bimetal 56 causing its free end to bend to the left (FIG. 2) so as to cooperate with a radial extension 58 of a trip bar 60 which is common to all thermal trip means of the three poles units. An adjustable screw 64 adjusts the space between the legs of U-shaped bracket 38 and allows the displacement of the assembly comprising rod 30 and bimetal 56 to vary the space between the free end of bimetal 56 and the extension 58 so as to adjust the thermal tripping characteristics of trip unit 12. The thermal trip bar 60 is pivotally supported by means of pins 62 set in apertures provided in the housing 42 and comprises extensions 58 in front of each bimetal 56 of the different poles.

The working of the thermal trip means is as follows: The current flowing in the conductor 16 produces an electromagnetic field in the magnetic circuit 28 and induces eddy currents in the short-circuit loop of secondary winding 54. The heat generated in the loop is conducted to bimetal 56 which bends to the left to engage the extension 58. Upon the occurrence of an overload current above a predetermined value, the thermal trip bar 60 rotates clockwise to disengage the latch (not shown) which in turn releases the cradle of the operating mechanism 21 and trips the circuit breaker open. It is noted that the thermal tripping characteristic of trip unit 12 varies as the sum of the air gaps 50, 52. The trip units 12 of different characteristics comprise magnetic rods 30 of different length, and the sum of air gaps 50, 52 is defined by the length of rod 30 and the space between opposite legs 22, 24 of the U-shaped core 26. The relative position of rod 30 with respect to the core 26 does not affect the thermal tripping characteristic of trip unit 12. The screw 64 allows an individual adjustment of bimetal 56 by variation of the space arranged between the legs of U-shaped bracket 38 which causes a corresponding translation of bimetal 56 with respect to the extension 58 of trip bar 60.

The electromagnetic trip means comprises a movable armature 66 of magnetic material facing the front faces 46 of legs 22, 24 and comprising a support rod 68 slidably mounted upon a L-shaped support member 70. An adjustable screw 72 secures the support member 70 to the molded housing 42 of trip unit 12, and causes the variation of the air gap arranged between the movable armature 66 and the front faces 46 of opposite legs 22, 24. A compression spring is inserted between support member 70 and stop means 76 fixed to support rod 68, and urges the movable armature 66 towards the unattracted position shown in FIG. 1, in engagement with support member 70. Stop means 76 cooperates with a driving pin 78 of a rotative electromagnetic trip bar 80 which is common to all electromagnetic trip means of the three pole units. The electromagnetic field produced by a short-circuit current flowing in conductor 16 may attract the movable armature 66 towards the front faces 46, pulling the rod 68 down causing the electromagnetic trip bar 80 to rotate clockwise. Upon release of the cradle of operating mechanism 21, occurs the tripping of the circuit breaker and movement of the movable contact arms of all poles to the open position.

The base bottom 34 of the circuit-breaker 10 is provided with suitable insulating barrier means 82 which separate the case into three adjacent compartments for housing the three poles. Trip unit 12 rests on the upper edges 84 of barrier means 82, and is positioned at a predetermined vertical level with a precision depending on the deformations of insulating molded materials which may affect the electromagnetic tripping characteristics. To become free from these defects, the housing 42 of trip unit 12 comprises projections 86 which bear on the opposite faces 88 of legs 22, 24. Upon assembling of trip unit 12 on the circuit breaker assembly, the projections 86 push back the U-shaped cores 26 biased downwardly against leaf-springs 44. The movable armature 66 occupies a suitable position with respect to projections 86 of housing 42 and the front faces 46 of legs 22, 24 so as to effect an electromagnetic tripping of circuit breaker at a predetermined threshold of the current.

The trip unit 12 is secured to circuit breaker assembly 10 by any suitable fastening means, more particularly by ratched devices allowing a fast assembling. At the disassembling of trip unit 12, the U-shaped core 26 of magnetic circuit 28 remains in the same place on circuit breaker assembly 10. All other tripping elements such as magnetic rod 30, bimetal 56, thermal trip bar 60, movable armature 66 and electromagnetic trip bar stay locked with the removable trip unit 12. Adjustment operations occur after assembling of trip unit 12, and entrust to the customer or to the distributor which will dispose a range of trip units having different ratings obtained by suitable magnetic rods 30 of different length and by a relative positioning of armature 66. It is noted that the thermal tripping characteristic defined by the sum of air gaps 50, 52, is independent of any shims or stop means, and that air gaps' faces are not subjected to any attrition which may change the tripping characteristics.

Figure 4:
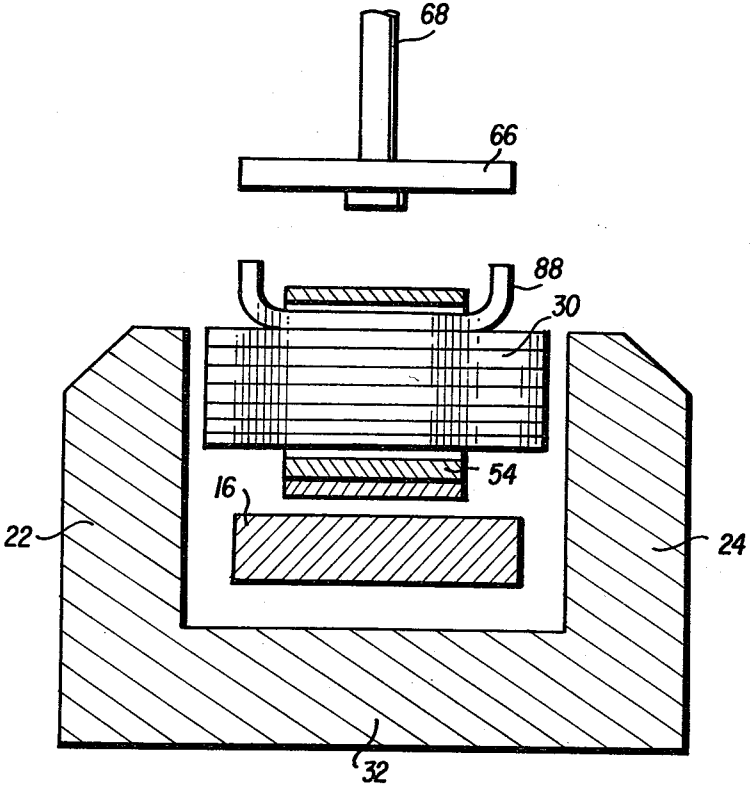
FIG. 4 is a vertical cross section taken through line IV—IV of FIG. 3.
Figure 3:
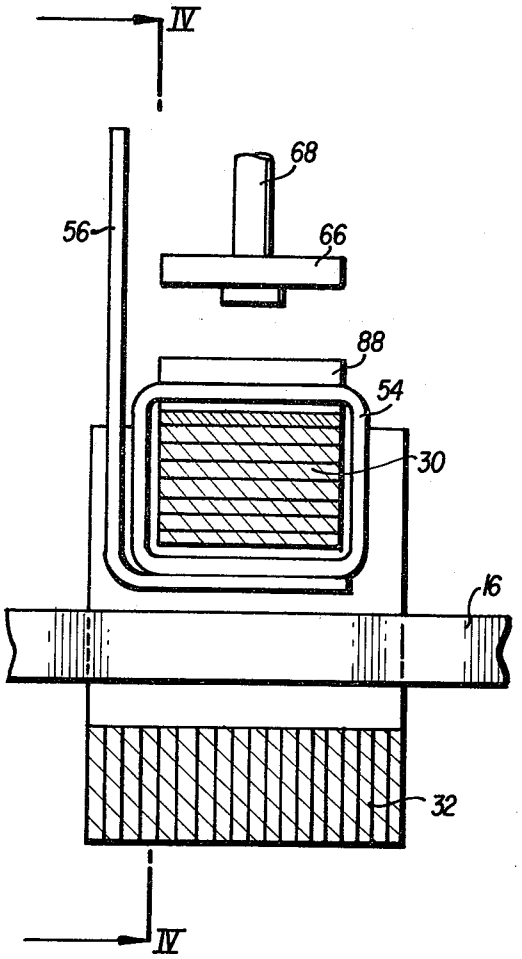
FIG. 3 is a partial view similar to FIG. 2, showing another embodiment of the trip unit.

Another embodiment of the invention is shown in FIG. 3 and 4. The movable magnetic armature 66 is positioned in front of a U-shaped magnetic yoke 88 having a portion secured to rod 30. A part of magnetic flux flowing through rod 30 is shunted by yoke 88 which acts to attract armature 66. The short-circuit loop 54 surrounds rod 30 and yoke 88 and the thermal tripping is not affected by the presence of yoke 88. Upon occurrence of heavy short-circuits, the armature 66 is attracted against yoke 88 so as to trip the circuit breaker. The value of the tripping flux is proportional to the flux in rod 30 which is independent of the position of rod 30 between legs 22, 24. The projections 86 which act to position correctly the consecutive parts 26, 66 of magnetic circuit 28 are omitted in this embodiment.

The invention is not limited to the described embodiments with reference to the accompanying drawings, but it extends to the variant in which rod 30 may be secured to circuit breaker assembly 10, while the U-shaped core 26 may be fastened to trip unit 12.

What is claimed is:

1. A molded case multi-pole circuit breaker comprising:

a current breaking assembly including adjacent poles each having a pair of separable contacts, an interchangeable trip unit comprising a trip structure for opening said contacts, said trip unit comprising associated to each pole a magnetic circuit to generally encompass an opening and formed by two separable portions, a first portion having a U-shaped core member with opposite legs and a second portion including a separate rod member having end faces inserted between opposite legs of said U-shaped core member upon assembly of said trip unit, a main conductor connected in electrical series with said pair of separable contacts and passing through said opening, one of said portions being secured to the breaking assembly and the other being removable and integral with said interchangeable trip unit, a bimetal support member associated to said other portion and adapted to be heated by hysteresis and eddy current losses therein when said conductor is energized, a bimetal element supported on said bimetal support member in a heat conducting relationship with said bimetal support member, said bimetal element operating said trip structure in response to being heated a predetermined amount to effect opening of said contacts to thereby provide a thermal tripping operation, magnetic air gap means defined between said legs and said end faces wherein the sum of said air gap means is independent of the relative position of said separable portions whereby said hysteresis and eddy current losses in said other portion remain independent of said relative position permitting replacement of the interchangeable trip unit without disconnection of said main conductor and accurate positioning of said separable portions.

2. A circuit breaker according to claim 1, having selectable high current ratings upon assembling of a given interchangeable trip unit enclosed within a range of trip units, wherein the different trip units of said range include rod members of said magnetic circuit having variable lengths so as to define different air gaps of said magnetic circuit and different tripping characteristics.

3. A circuit breaker according to claim 2, wherein said rod member is integral with said interchangeable trip unit.

4. A circuit breaker according to claim 3, having a movable armature integral with said interchangeable trip unit and facing the opposite legs upon assembling of said trip unit so as to be attracted when said conductor is energized a predetermined amount operating said trip structure to effect opening of said contacts.

5. A circuit breaker according to claim 3, comprising a movable armature integral with said interchangeable trip unit and a magnetic yoke linked with said rod member as a magnetic flux shunt and with said movable armature so as to attract said movable armature when said conductor is energized a predetermined amount operating said trip structure to effect opening of said contacts.

6. A multipole circuit breaker comprising:

a pair of separable contacts for each pole;

an interchangeable trip unit for opening said contacts, said trip unit comprising two seperable portions, a first portion including a U-shaped core having a pair of legs encompassing a current carrying conductor connected to a pole, and a second portion including a magnetic rod disposed between said legs and forming a pair of magnetic gaps therewith when said trip unit is assembled, said magnetic rod including a winding which receives an induced current in response to a change in current in said conductor, and a bimetallic element having one end connected to said winding and the remaining end free to move in response to a temperature change resulting from said induced current;

a slidable armature of magnetic material mounted for linear movement to and from said legs, said armature having biasing means for holding said armature apart therefrom until a threshhold level of magnetism is generated in said legs; and means responsive to motion of said armature and said bimetallic element free end for opening said contacts.

* * * * *